United States Patent [19]

Zeischegg et al.

[11] 4,411,318

[45] Oct. 25, 1983

[54] FIRE-EXTINGUISHING WASTE RECEPTACLE

[76] Inventors: Walter Zeischegg, Turmstr. 43, 7910 Neu-Ulm; Bernd Brussing, Öschwende 38, 7900 Ulm, Donau, both of Fed. Rep. of Germany

[21] Appl. No.: 285,750

[22] Filed: Jul. 22, 1981

[30] Foreign Application Priority Data

Jul. 23, 1980 [DE] Fed. Rep. of Germany ..... 3027813

[51] Int. Cl.[3] ..... A62C 35/02

[52] U.S. Cl. ..... 169/26; 220/88 B

[58] Field of Search ..... 169/54, 26, 19, 52, 169/56, 57, 30, 64; 220/88 R, 88 B, 89 R, 89 B, 859, 201, 3.1

[56] References Cited

U.S. PATENT DOCUMENTS

| | | | |
|---|---|---|---|
| 1,325,769 | 12/1919 | Welch | 169/26 |
| 2,718,330 | 9/1955 | Adamson | 220/88 B |
| 2,917,116 | 12/1959 | Wyant | 169/26 |
| 3,206,061 | 9/1965 | Feldman | 169/26 |
| 3,489,223 | 1/1970 | Bundo, Sr. | 169/26 |

*Primary Examiner*—Kenneth W. Noland

*Attorney, Agent, or Firm*—Karl F. Ross; Herbert Dubno

[57] ABSTRACT

A waste receptacle comprises an upwardly open fire-resistant vessel having an upper rim, an annular head piece fittable over the rim and forming an upwardly open waste-passing mouth, a container mounted on the rim and holding a pressurized substance which when released at ambient pressure forms a gas that does not support combustion and that is heavier than air, a heat-conducting nozzle carried on the rim, connected to the container, and opening into the vessel, and a plug of fusible material blocking the nozzle and having a relatively low melting point. The container may be a halon- or $CO_2$-containing bottle and the melting point of the nozzle plug is about 70° C. The head piece is easily separable from the vessel for emptying of same, and can be opened up to replace the gas-containing bottles and nozzles.

10 Claims, 5 Drawing Figures

FIRE-EXTINGUISHING WASTE RECEPTACLE

FIELD OF THE INVENTION

The present invention relates to a waste receptacle. More particularly this invention concerns such a receptacle which is fire-proof or fire-retardant.

BACKGROUND OF THE INVENTION

A waste-paper receptacle is a particularly fire-prone location, since its contents are normally highly flammable and loose. Accordingly fire-extinguishing receptacles are known, as for example the type sold under the trade name Fire Check by Protectoseal of Bensenville, Ill., which have a downwardly U-section rim that deflects upwardly rising oxygen-depleted combustion gases back into the receptacle to smother the fire therein.

Such arrangements are relatively effective for small fires. When a smoldering fire starts, however, the gases can sometimes rise from it straight up and out the mouth of the receptacle. Meanwhile the heat of the fire can be transmitted through the walls of the receptacle to set adjacent flammable material on fire.

A violent fire whose flames shoot up beyond the extinguishing head of the receptacle can similarly go out of control with such a receptacle, as the violent air currents can cause enough circulation to maintain the fire. Furthermore such a violent fire can frequently destroy the receptacle before the self-extinguishing feature has a chance to work.

DESCRIPTION OF THE INVENTION

It is therefore an object of the present invention to provide an improved fire-preventing or -retarding waste receptacle.

Another object is the provision of such a receptacle which will automatically extinguish a smoldering or violent fire in itself.

SUMMARY OF THE INVENTION

These objects are attained according to the instant invention in a waste receptacle comprising an upwardly open fire-resistant vessel having an upper rim, an annular head piece fittable over the rim and forming an upwardly open waste-passing mouth, a container mounted on the rim and holding a pressurized substance which when released at ambient pressure forms a gas that does not support combustion and that is heavier than air, a heat-conducting nozzle carried on the rim, connected to the container, and opening into the vessel, and a plug of fusible material blocking the nozzle and having a relatively low melting point.

Thus the system according to the instant invention actively puts out the fire in the vessel. As soon as the plug in the nozzle is heated, normally to a temperature below 80° C. and around 70° C., it melts, the extinguishing gas is released, and the fire is put out. Even if the fire is of the relatively cool smoldering type it will melt the nozzle plug, and obviously a hot fire will melt it immediately. The waste receptacle of this invention relies on well known technology to ensure that the fire will be extinguished by application to it of the extinguishing gas, which may be carbon dioxide, a halocarbon such as Halon, or the like, from a nozzle of the type provided in a sprinkler that is certain to work even after having sat idle for a long time. Obviously the nozzle is sacrificial, but the expense of replacing such a cheap part is small compared to the damage a fire can cause. Another advantage is that it is easy to make the head of the receptacle of the instant invention of modest dimensions so it still leaves a relatively large waste-passing hole, unlike the prior-art structures which greatly restrict this opening.

According to further features of this invention, the head piece carries a plurality of such nozzles directed centrally of the vessel. In this manner complete extinguishing of any fire is ensured, since obviously the heavier-than-air gas will drop to fill the vessel and extinguish the fire therein.

According to another feature of this invention the container is a gas bottle and the head piece forms an annular chamber containing this gas bottle. If $CO_2$ is used a standard small capsule such as is used in soda syphons can be employed.

In accordance with another feature of the invention the head piece sits on the rim and can be lifted therefrom. The head piece has an outer wall formed with an inner shoulder sitting on the rim and the outer wall has a bent-in upper edge forming the bottle-containing chamber. This outer wall is formed of an inner part and an outer part together forming the chamber. The receptacle according to this invention has a metal liner which is in heat-transmitting engagement with the nozzle. Thus the heat of any fire in the receptacle will be transmitted rapidly to the nozzle and through this nozzle to the plug.

In order to prevent the extinguishing gas from being injected into the vessel from blowing out any burning material therein, the rate at which this gas exits can be controlled by providing the system of this invention with a conduit between the container and the nozzle and a flow-control valve in the conduit. Thus the flow rate can be adjusted to allow the extinguishing nozzle to flow gently into the vessel to snuff out the fire therein.

DESCRIPTION OF THE DRAWING

The above and other features and advantages will become more readily apparent from the following, reference being made to the accompanying drawing in which.

SPECIFIC DESCRIPTION

Figure 1:
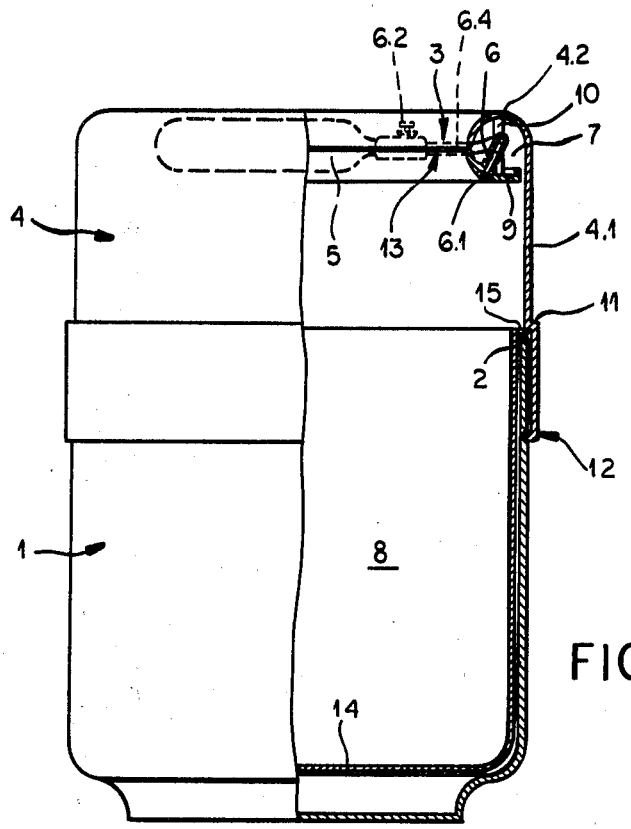
FIG. 1 is a side view partly in section showing a waste receptacle according to this invention.

A fire-extinguishing waste receptacle according to the instant invention has an upwardly open vessel 1 on whose rim 2 sits a rectangularly annular head piece 4 that forms a square waste-passing opening 3 through which waste can be dropped to the interior 8 of the vessel 1. This head piece 4 has an outer wall 4.1 that is bent in at 4.2 and fitted at 13 to an inner wall portion 9 that defines an annular chamber 7 containing a plurality of $CO_2$ cartridges or bottles 5 connected to nozzles 6 closed with fusible plugs 6.1 and directed into the interior 8 of the vessel 1. Valves 6.2 provided in conduits 6.4 between the bottles 5 and the nozzles 6 allow the flow rate of the gas to be adjusted.

The wall 4.1 is formed with an outward shoulder 11 that sits atop the rim 2 and has at its lower edge bosses 12 that engage in corresponding recesses on the outside of the vessel 1 to hold the head piece 4 securely in place thereon. Screws 10 in the corners of the head piece 4 join the wall portions 4.2 and 9 together so that these screws can be released to drop the portion 9 carrying the bottles 5 and nozzles 6 and thereby gain access to the interior of the chamber 7. The vessel 1 has a metallic liner 14 formed with an upper-edge lip 15 that sits atop the rim 2. The head piece 4 and vessel 1 are normally made of a durable synthetic resin such as nylon.

Figure 2:
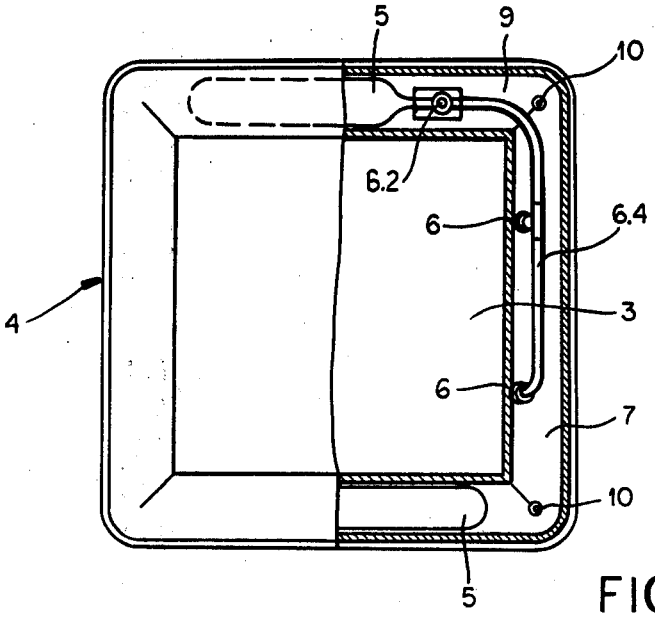
FIG. 2 is a partly sectional top view of the receptacle of FIG. 1.
Figure 3:
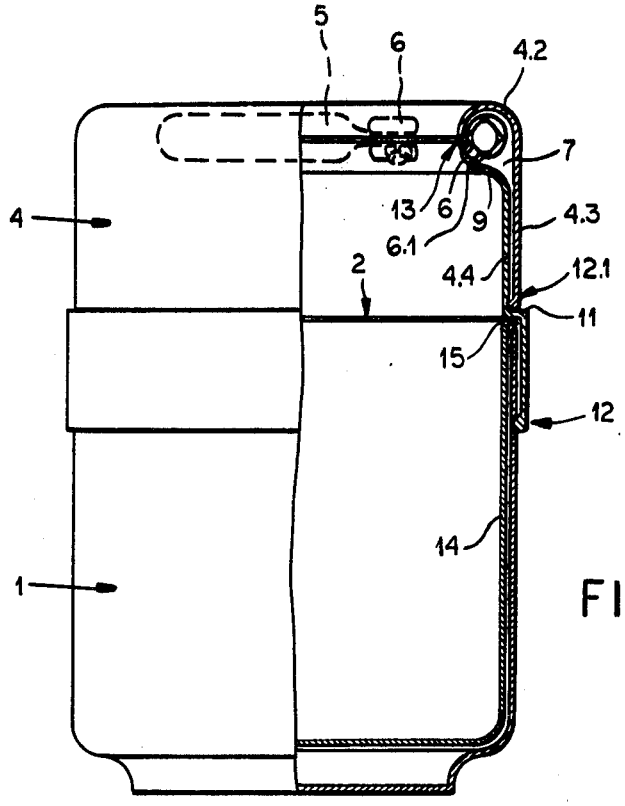
FIGS. 3 and 4 are views corresponding respectively to FIGS. 1 and 2 showing another receptacle according to this invention.
Figure 4:
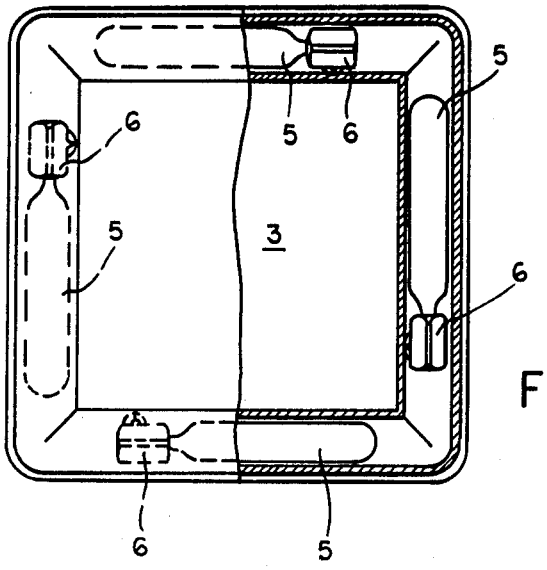
Figure 5:
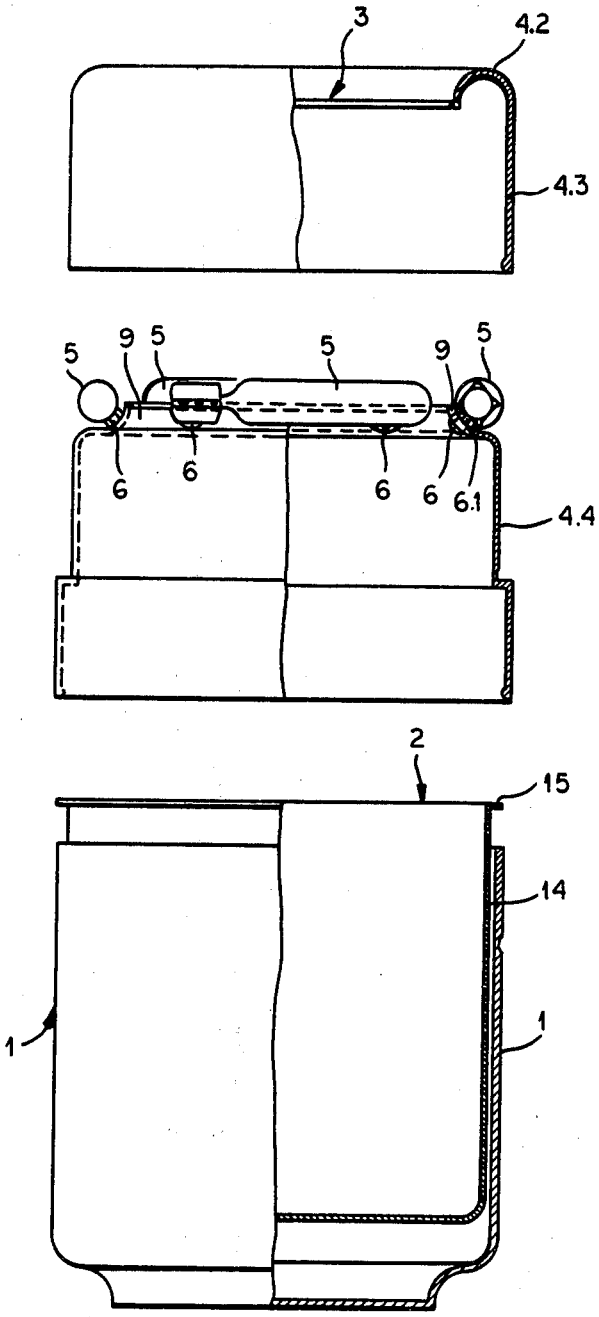
FIG. 5 is a partly sectional exploded view of the receptacle as shown in FIG. 3.

In FIGS. 3–5 the same reference numerals as in FIGS. 1 and 2 are used for identical structure. Here, however, the head piece has an outer wall part 4.3 formed with the upper portion 4.2 and an inner wall part 4.4, with bosses 12.1 snap-fitting the two together. The inner part 4.4 is normally made of metal to conduct heat to the nozzles 6. In this system therefore the outer part 4.3 is snapped off to change the bottles 5.

One bottle 5 is provided with its own respective inwardly directed nozzle 6 on each side of the head piece of FIGS. 3–5 whereas in FIGS. 1 and 2 only two bottles are provided on opposite sides each connected to two nozzles 6 on the adjacent side. In either case once the relatively low melting point—normally about 70° C.—of the nozzle plugs 6.1 is exceeded, the gas is directed inward and downward in the interior 8 to cut off the supply of oxygen to any fire therein.

The system according to the instant invention will therefore automatically put out any fire in the vessel 1. It will extinguish even a relatively low-temperature smoldering fire, and of course will instantly act on a hot fire. The use of fusible plugs in the nozzles has the advantage of very low cost and extremely high reliability.

We claim:

1. A waste receptacle comprising:

an upwardly open vessel having an upper rim;

an annular head piece fittable over said rim and forming a vertically throughgoing waste-passing mouth;

a container in the form of a gas bottle mounted on said rim and holding a pressurized substance which when released at ambient pressure forms a gas that does not support combustion and that is heavier than air, said head piece forming an annular chamber containing said gas bottle;

a heat-conducting nozzle carried on said rim, connected to said container, and opening into said vessel;

a plug of fusible material blocking said nozzle and having a melting point below 80° C.

2. The receptacle defined in claim 1 wherein said melting point is about 70° C.

3. The receptacle defined in claim 1 wherein said head piece carries a plurality of such nozzles directed centrally of said vessel.

4. The receptacle defined in claim 1 wherein said head piece sits on said rim and can be lifted therefrom.

5. The receptacle defined in claim 4 wherein said head piece has an outer wall formed with an inner shoulder sitting on said rim.

6. The receptacle defined in claim 4 wherein said outer wall has a bent-in upper edge forming said chamber.

7. The receptacle defined in claim 6 wherein said head piece provides an inner and an outer wall together forming said chamber.

8. The receptacle defined in claim 1 wherein said vessel has a metal liner.

9. The receptacle defined in claim 8 wherein said metal liner is in heat-transmitting engagement with said nozzle.

10. The receptacle defined in claim 1, further comprising:

a conduit between said container and said nozzle; and a flow-control valve in said conduit.

* * * * *